US010969066B1

(12) United States Patent
Ormsbee et al.

(10) Patent No.: US 10,969,066 B1
(45) Date of Patent: Apr. 6, 2021

(54) SYSTEMS AND METHODS FOR AN EFFICIENT, RECHARGEABLE GLOWSTICK

(71) Applicant: Nite Ize, Inc., Boulder, CO (US)

(72) Inventors: Bowden Ormsbee, Longmont, CO (US); Leo Lesperance, Erie, CO (US)

(73) Assignee: Nite Ize, Inc., Boulder, CO (US)

( * ) Notice: Subject to any disclaimer, the term of this patent is extended or adjusted under 35 U.S.C. 154(b) by 0 days.

(21) Appl. No.: 16/685,784

(22) Filed: Nov. 15, 2019

(51) Int. Cl.

| | |
|---|---|
| ***F21L 4/08*** | (2006.01) |
| ***F21K 2/08*** | (2006.01) |
| ***F21V 21/088*** | (2006.01) |
| ***F21L 14/02*** | (2006.01) |
| *F21Y 103/00* | (2016.01) |
| *F21V 23/00* | (2015.01) |

(52) U.S. Cl.
CPC ..... *F21L 4/08* (2013.01); *F21K 2/08* (2013.01); *F21L 14/026* (2013.01); *F21V 21/0885* (2013.01); *F21V 23/005* (2013.01); *F21Y 2103/00* (2013.01)

(58) Field of Classification Search
CPC .. F21K 2/08; F21L 14/026; F21L 4/08; F21V 21/0885; F21V 33/0004; F21V 33/008; F21V 23/004; F21V 23/005; F21Y 2103/00
See application file for complete search history.

(56) References Cited

U.S. PATENT DOCUMENTS

| | | | | |
|---|---|---|---|---|
| 2,340,530 | A * | 2/1944 | Hefner | F21L 4/00 362/282 |
| 5,079,679 | A * | 1/1992 | Chin-Fa | F21V 33/0064 362/102 |
| 5,081,568 | A * | 1/1992 | Dong | F21V 23/0414 362/184 |
| 5,117,341 | A * | 5/1992 | Huang | F21L 2/00 362/184 |
| 5,493,482 | A * | 2/1996 | Bowen | F21L 14/026 362/219 |
| 7,611,254 | B1 * | 11/2009 | Yu | A63H 23/005 362/101 |
| 2006/0082988 | A1 * | 4/2006 | Riblett | F21L 4/02 362/120 |
| 2007/0019398 | A1 * | 1/2007 | Chen | F16M 13/04 362/102 |
| 2007/0121332 | A1 * | 5/2007 | Liu | F21L 4/005 362/459 |
| 2011/0216533 | A1 * | 9/2011 | Bertken | F21L 4/005 362/205 |
| 2012/0257377 | A1 * | 10/2012 | Schrimmer | F21L 4/027 362/119 |
| 2012/0262909 | A1 * | 10/2012 | Campman | F21V 23/0414 362/102 |

(Continued)

*Primary Examiner* — Zheng Song
(74) *Attorney, Agent, or Firm* — Haynes & Boone, LLP

(57) ABSTRACT

A glowstick includes a lighting module, the lighting module including a light source having a primary direction of emission. The glowstick further includes a polymer rod, the polymer rod interfaced with the lighting module, the polymer rod having a length, a depth, and a width, wherein the length is greater than the depth and the length is greater than the width, the polymer rod proximate to the light source such that the primary direction of emission of the light source is aligned with the length of the polymer rod.

19 Claims, 12 Drawing Sheets

(56) References Cited

U.S. PATENT DOCUMENTS

| | | | | |
|---|---|---|---|---|
| 2012/0275142 | A1* | 11/2012 | Lundy | F21L 4/027 362/184 |
| 2013/0170236 | A1* | 7/2013 | Hsieh | F21V 21/30 362/374 |
| 2013/0250558 | A1* | 9/2013 | Griffin | F21V 9/30 362/183 |
| 2016/0111903 | A1* | 4/2016 | Miller | F21L 4/085 362/183 |
| 2019/0120470 | A1* | 4/2019 | Qin | F21V 21/40 |

* cited by examiner

SYSTEMS AND METHODS FOR AN EFFICIENT, RECHARGEABLE GLOWSTICK

BACKGROUND

Visibility is an important safety concern in many scenarios. Ordinarily it is not desirable to have a concentrated light source, since such light sources may be blinding in low light conditions. A single point source of light may not be large enough to be noticeable to parties at a lower level, so it is desirable to have a light defusing mechanism, in order to light a larger area at a lower light level.

BRIEF SUMMARY

In one embodiment, a glowstick includes a lighting module, the lighting module including a light source having a primary direction of emission. The glowstick further includes a polymer rod, the polymer rod interfaced with the lighting module, the polymer rod having a length, a depth, and a width, wherein the length is greater than the depth and the length is greater than the width, the polymer rod proximate to the light source such that the primary direction of emission of the light source is aligned with the length of the polymer rod. Alternatively, the lighting module has a body portion and the polymer rod extends into the body portion. In one alternative, the body portion includes an inner profile and the lighting module further includes a collet and a collar, the collet engaged with the inner profile, the collar, and the polymer rod such that the collet pushes the collar against the polymer rod and the inner profile, compressing the collar and holding the polymer rod in place. In another alternative, the polymer rod is held via an interference fit. Alternatively, the collar is between the polymer rod and the inner profile. In one alternative, the inner profile has a step profile being more narrow towards an end of the polymer rod distal from the lighting module and less narrow towards an end of the polymer rod proximate to the lighting module, and the collar, the collet, the polymer rod, and the inner profile cooperate to assist in holding the polymer rod in place at the end of the polymer rod proximate to the lighting module. In another alternative, the collet holds a circuit board, the circuit board including the light source, such that the light source is proximate to the polymer rod and the primary direction of emission is aligned with the length. Alternatively, a collet in the lighting module holds a circuit board, the circuit board including the light source, such that the light source is proximate to the polymer rod and the primary direction of emission is aligned with the length. In another alternative, the lighting module includes a lower body portion and a cap and an internal cap, wherein the internal cap is fixed in place and the cap interfaces with the internal cap to seal the cap to the lower body portion. Alternatively, the internal cap includes a lip and the cap includes a rib and the lip and the rib interface. In another alternative, the internal cap includes a rib along the lip and the cap include a detent, the detent interfacing with the rib when the cap is closed on the lower body. Alternatively, the internal cap includes a compression bump near the lip, the compression bump interfacing with the rib to provide positive resistance to rotation of the cap. In another alternative, a charge port is accessible under the cap through the internal cap.

In one embodiment, a glowstick includes a lighting module, including a light source, the light source having an emission direction. The glowstick further includes a light diffusion element, the light diffusion element having a length, a width, and a depth, the length greater than the width and the length greater than the depth, the emission direction aligned with the length, the lighting module interfaced with the light diffusion element. Alternatively, the light diffusion element is a polymer rod. In one alternative, the lighting module has a body portion and the polymer rod extends into the body portion. In another alternative, the body portion includes an inner profile and the lighting module further includes a collet and a collar, the collet engaged with the inner profile, the collar, and the polymer rod such that the collet pushes the collar against the polymer rod and the inner profile, compressing the collar and holding the polymer rod in place. Alternatively, the lighting module has a body portion and the body portion holds the light diffusion element using an interference fit. In another alternative, a collar is included in the lighting module and the body portion and the light diffusion element compress the collar in providing the interference fit. Alternatively, a charge port is accessible under a cap of the lighting module.

In one embodiment, a method of using a glowstick includes providing a glowstick. The glowstick includes a lighting module, including a light source, the light source having an emission direction. The glowstick further includes a light diffusion element, the light diffusion element having a length, a width, and a depth, the length greater than the width and the length greater than the depth, the emission direction aligned with the length, the lighting module interfaced with the light diffusion element. The light diffusion element is a polymer rod. The lighting module has a body portion and the polymer rod extends into the body portion, and the body portion includes an inner profile and the lighting module further includes a collet and a collar. The collet engaged with the inner profile, the collar, and the polymer rod such that the collet pushes the collar against the polymer rod and the inner profile, compressing the collar and holding the polymer rod in place. A charge port is accessible under a cap of the lighting module. The method further includes removing the cap and charging the lighting module. The method further includes replacing the cap and activating the light source.

DETAILED DESCRIPTION

Certain terminology is used herein for convenience only and is not to be taken as a limitation on the embodiments of the systems and methods for an efficient, rechargeable glow stick. In the embodiments shown, the glowstick includes a uniquely oriented such that it abuts the light sources extremely closely. In many embodiments, it is desirable to have a light source that is in contact with or virtually in contact with the light source, in most cases an LED.

Figure 1:
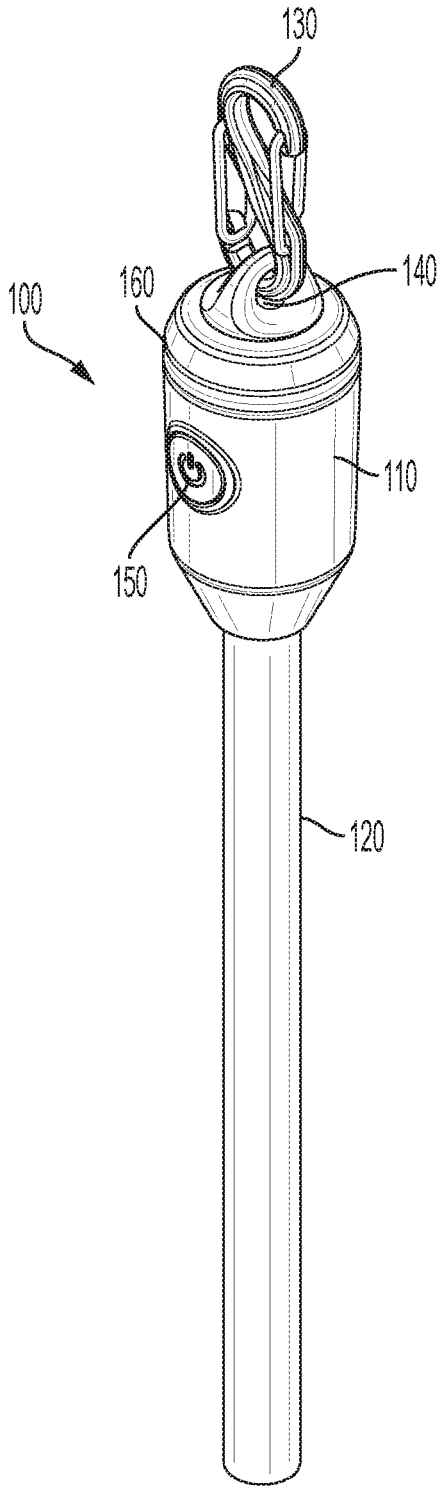
FIG. 1 shows one embodiment of an enhanced glowstick.
Figure 2:
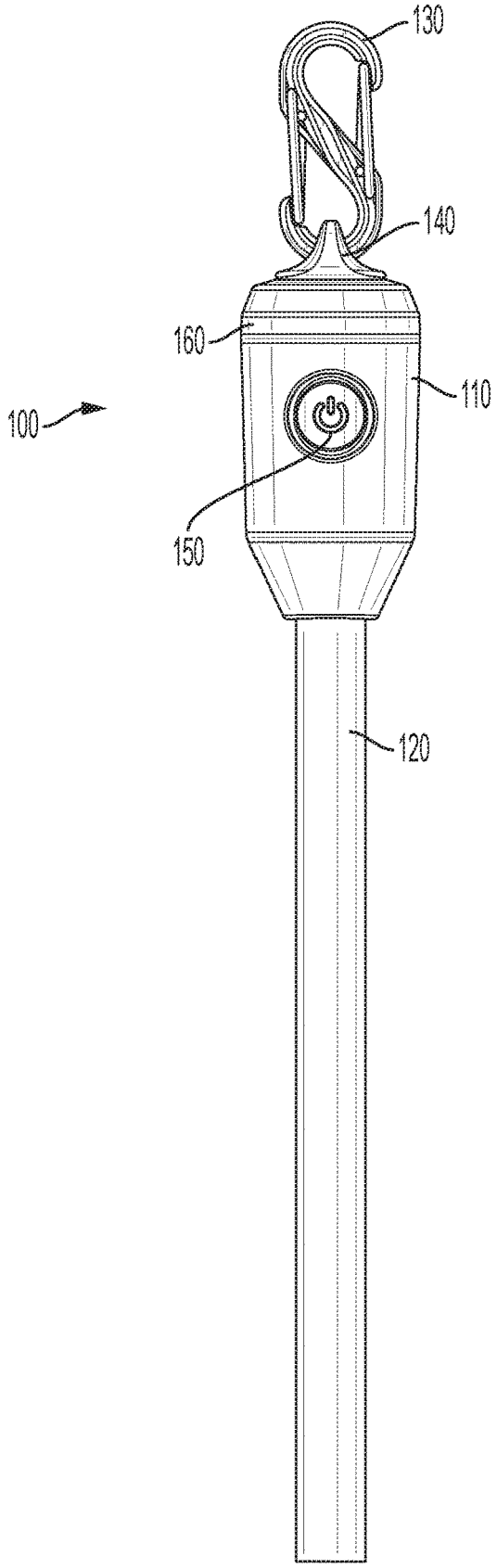
FIG. 2 shows top view of the enhanced glowstick of FIG. 1.
Figure 3:
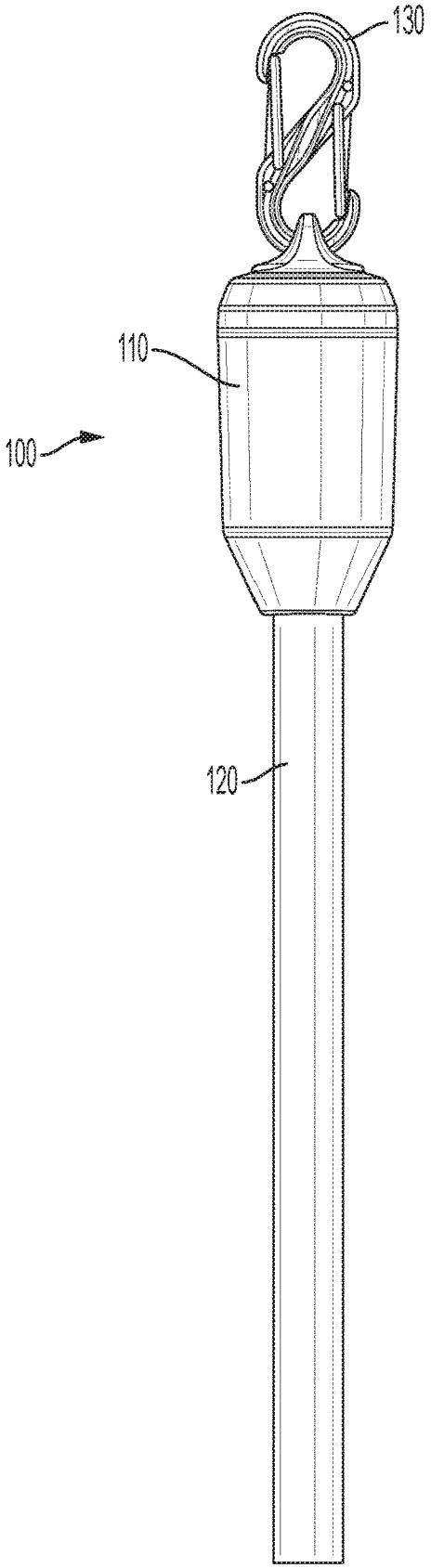
FIG. 3 shows a bottom view of the enhanced glowstick of FIG. 1.
Figure 4:
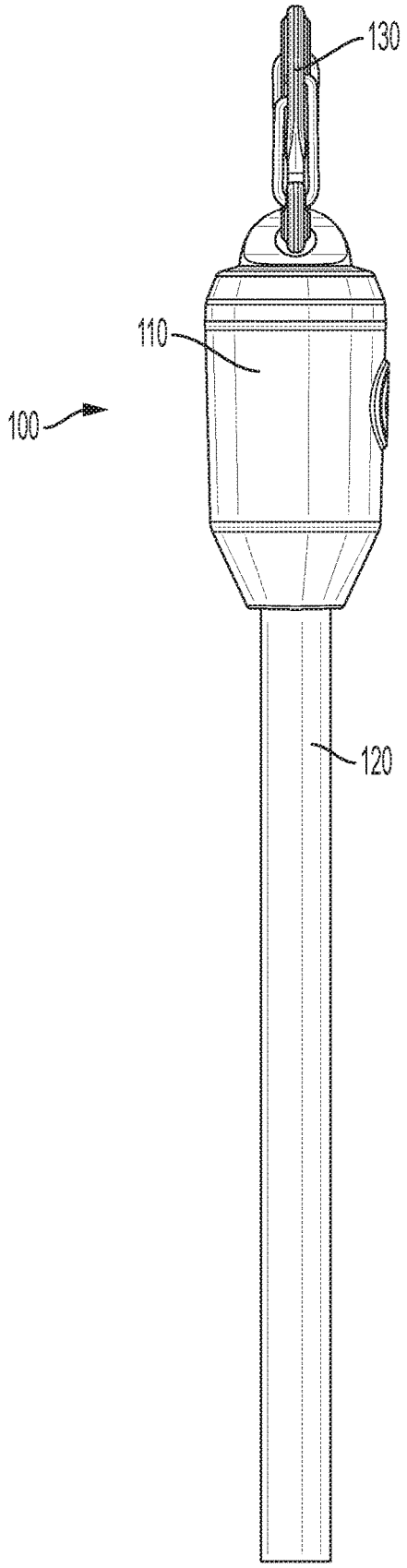
FIG. 4 shows a left side view of the enhanced glowstick of FIG. 1.
Figure 5:
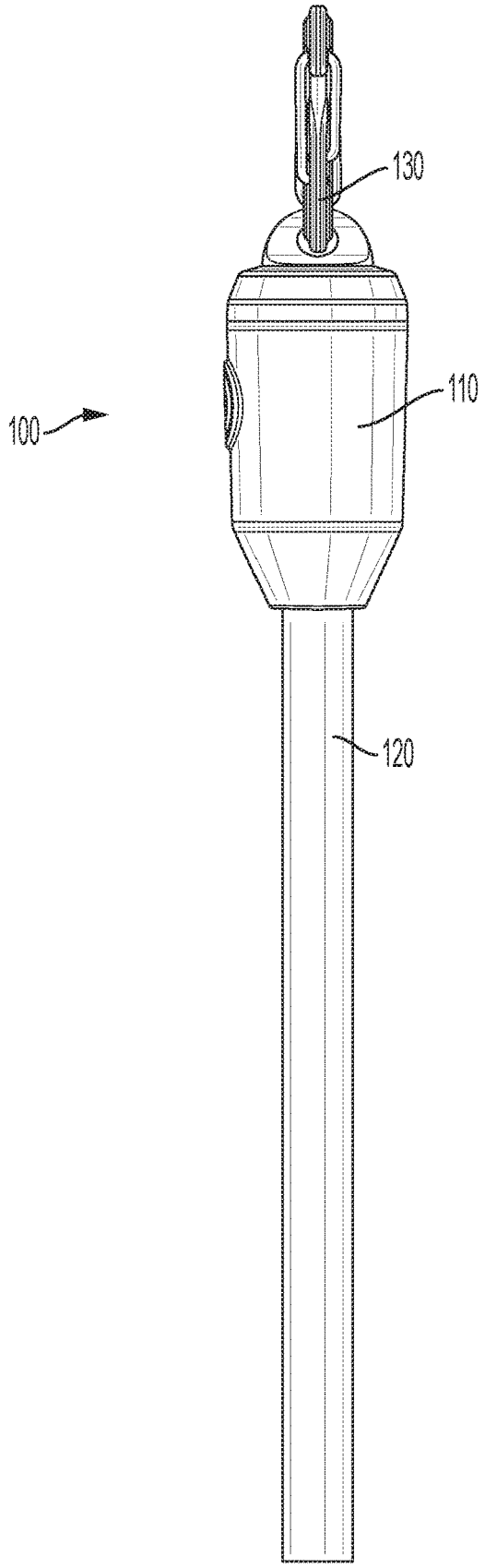
FIG. 5 shows a right-side view of the enhanced glowstick of FIG. 1.
Figure 6:
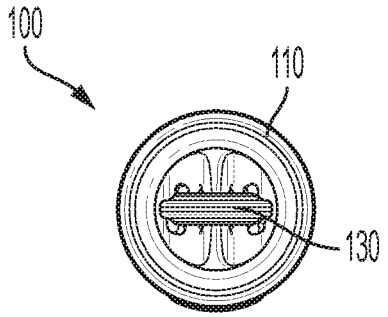
FIG. 6 shows a front view of the enhanced glowstick of FIG. 1.
Figure 7:
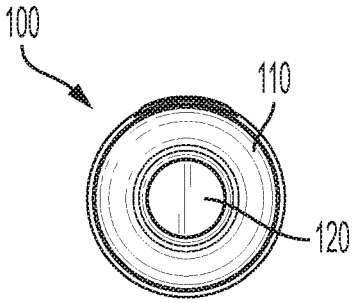
FIG. 7 shows a rear view of the enhanced glowstick of FIG. 1.

FIG. 1 shows one embodiment of an enhanced glowstick 100. Glowstick 100 includes a lighting module 110, a polymer stick portion 120, and carabineer 130. Polymer stick portion 120 is typically composed of transparent or translucent TPU (Thermoplastic polyurethane) or similar material. Lighting module 110 includes circuitry, light sources, and power sources that provide light to polymer stick portion 120. Carabineer 130 provides for attachment of the device to various connectors such as coats, backpacks, etc. Lighting module 110 includes a switch 150 for controlling the function of the glowstick 100. Carabineer 130 is connected to the lighting module 110 via eyelet 140. The top portion of lighting module 110 may be unscrewed and removed at connection point 160. FIG. 1 shows one embodiment of an enhanced glowstick. FIG. 2 shows a front view of glowstick 100. FIG. 3 shows a rear view of glowstick 100. FIG. 4 shows a left side view of glowstick 100. FIG. 5 shows a right-side view of glowstick 100. FIG. 6 shows a top view of glowstick 100. FIG. 7 shows a bottom view of glowstick 100.

Figure 8:
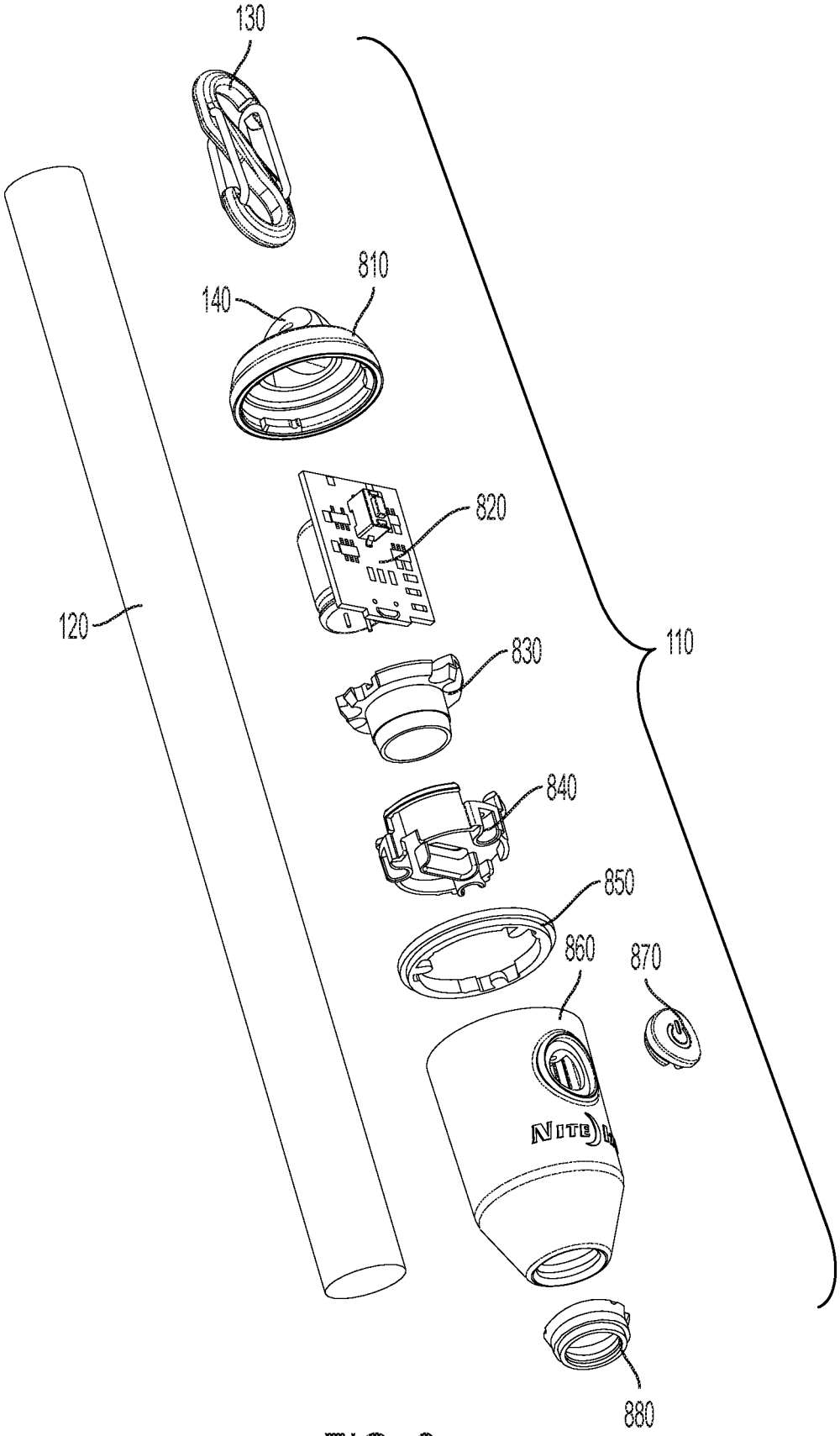
FIG. 8 shows an exploded view of the enhanced glowstick of FIG. 1.

FIG. 8 shows an exploded view of glowstick 100. Visible are lighting module 110 exploded, carabineer 130, and polymer stick portion 120. Lighting module 110 is broken up into cap 810 which includes eyelet 140, printed circuit board 820, collet 830, inner cap 840, rubber gasket 850, case 860, silicone button 870 (may be made of other materials), and silicone ring 880.

Figure 9:
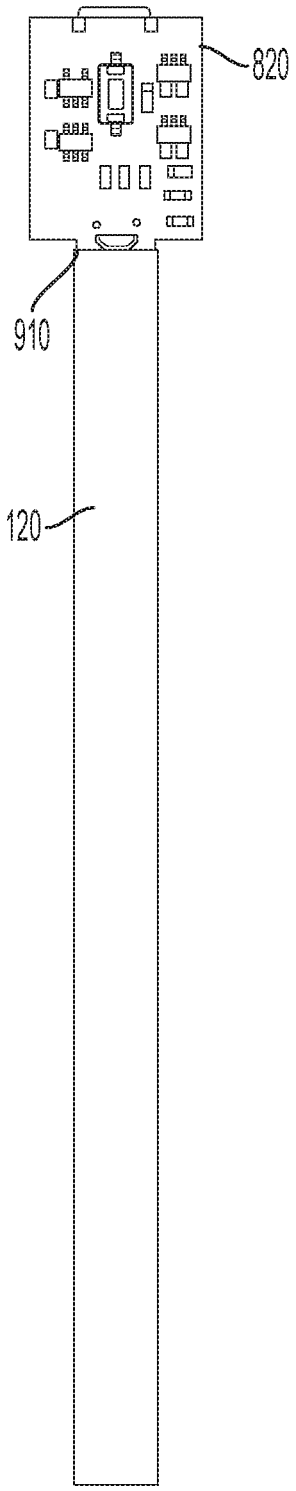
FIG. 9 shows one embodiment of a circuit board and polymer for use with embodiments of an enhanced glowstick.
Figure 10:
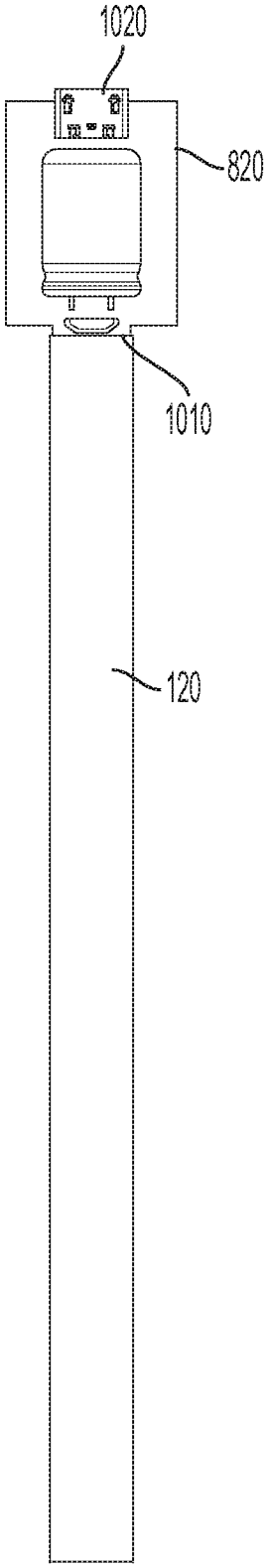
FIG. 10 the bottom view of the circuit board and polymer of FIG. 9.

FIG. 9 shows the printed circuit board 820 and polymer stick portion 120. As shown, the printed circuit board 820 includes a charge indicator light 910 that indicates when the device is charging. In FIG. 10, the opposite side of the printed circuit board 820 is shown. Here, charging USB 1020 is show as well as an LED 1010. Other charging ports are possible, like micro-USB, custom chargers, charge ports, or other ports. This this way the glowstick is rechargeable. Of course, the system includes a rechargeable battery in many configurations. In many embodiments, LED 1010 is a red/blue/green LED, such that multiple colors may be produced to light polymer stick portion 120. In some alternatives, a white LED is also included.

Figure 11:
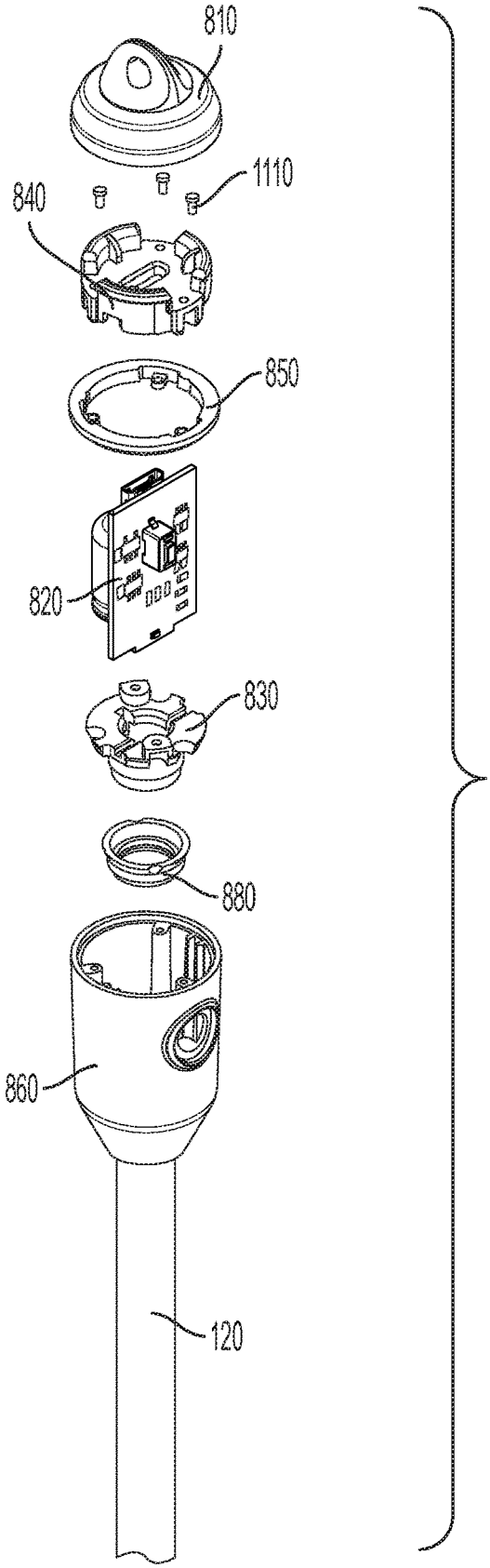
FIG. 11 shows an exploded view of the enhanced glowstick of FIG. 1.

FIG. 11 shows another exploded view of glowstick 100. In this view the order of parts is essentially how the device is assembled. Polymer stick portion 120 fits into body 860 and is held in place via silicone ring 880 and collet 830. Collet 830 wedges against silicone ring 880 and polymer stick portion 120 in order to provide a pressure fit arrangement. The collet 830 is shaped to hold the circuit board 820 as well, such that the light is held such that it abuts the polymer stick portion 120. The inner cap 840 is oriented such that it holds the circuit board 820 in place in body 860. The cap 810 is removably attached to the body 860 such that it may be removed to use USB 1020 for charging. Screws 1110 hold inner cap 840 in place.

Figure 12:
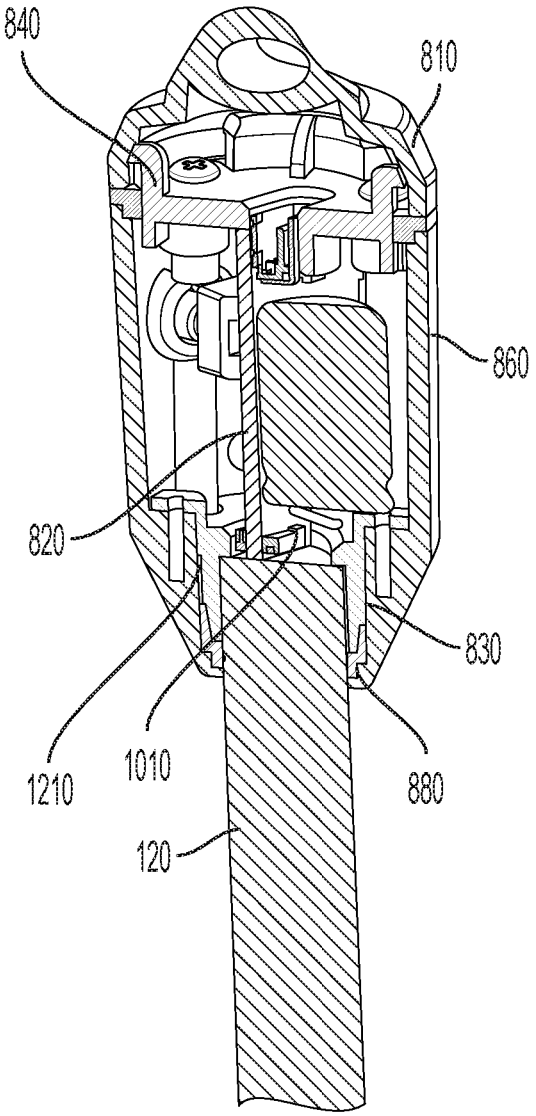
FIG. 12 shows a cutaway view of the enhanced glowstick of FIG. 1.

FIG. 12 shows a cut away view of the glowstick 100. Here it can be seen how collet 830 is designed to interface with silicone ring 880 and the inner body portion 1210 of body 860. As shown, the inner body portion 1210 has a step like profile. At the lower portion of the step like profile, the void area is less than the thickness of the silicone ring 880 and the polymer stick portion 120, such that when the collet 830 is screwed in the silicone ring 880 is compressed against the polymer stick portion 120 and the inner body portion 1210. Additionally, the upper stepped portion has a slightly larger void area, such that it can accommodate and compress collet 830, silicone ring 880, and polymer stick portion 120. As shown, LED 1010 is held tightly against polymer stick portion 120. This figure also shows how the inner cap 840 interfaces with the cap 810. This may also be referred to as an interference fit. Additionally, it is clear in this configuration that the LED 1010 is held in line with the length of the polymer stick portion 120, such that the primary emission direction of LED 1010 is aligned with this length.

Figure 14:
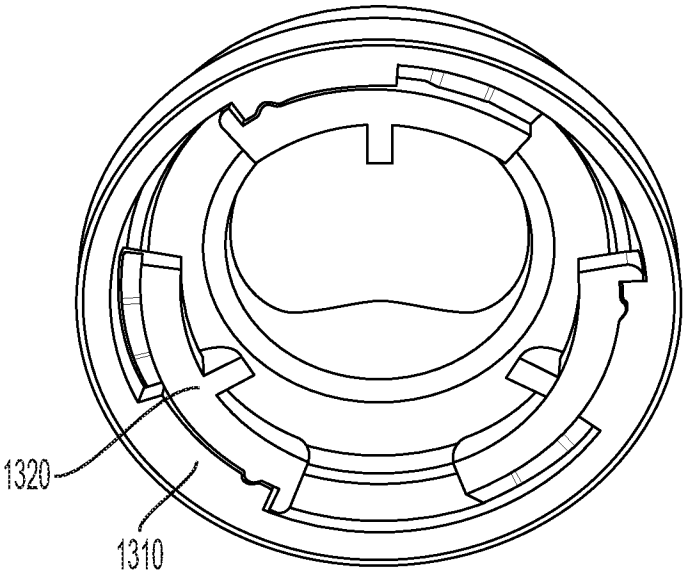
FIG. 14 shows a cutaway view of the cap of enhanced glowstick of FIG. 1.
Figure 13:
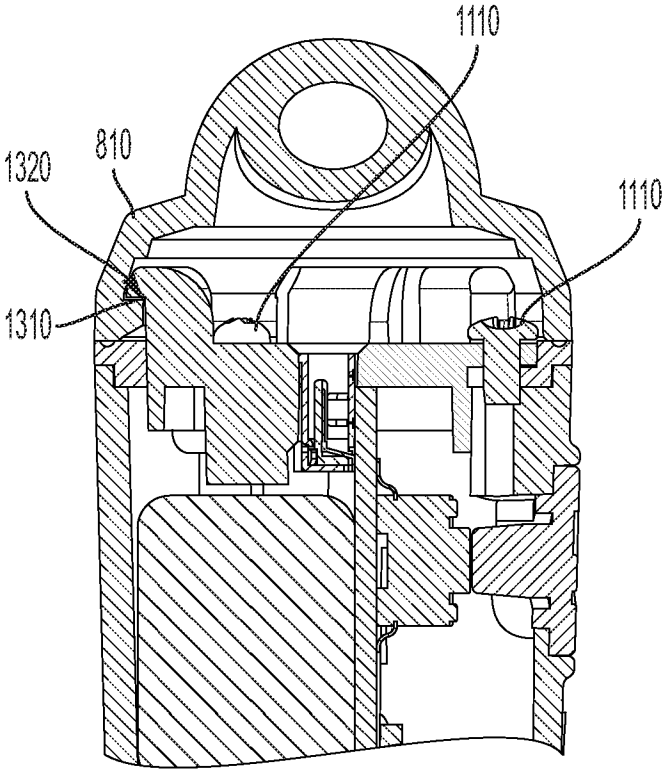
FIG. 13 shows a cutaway view of the enhanced glowstick of FIG. 1.

FIG. 13 shows additional view related to the cap 810. The cap 810 interfaces with the inner cap 840. Inner cap 840 includes a lip 1320 that holds against rib 1310 of cap 810. The cutaway version in FIG. 14 shows the lip 1320 and the rib 1310 engaged in a locked fashion. As can be seen, when the lips are turned out of alignment the cap 810 will release.

Figure 15:
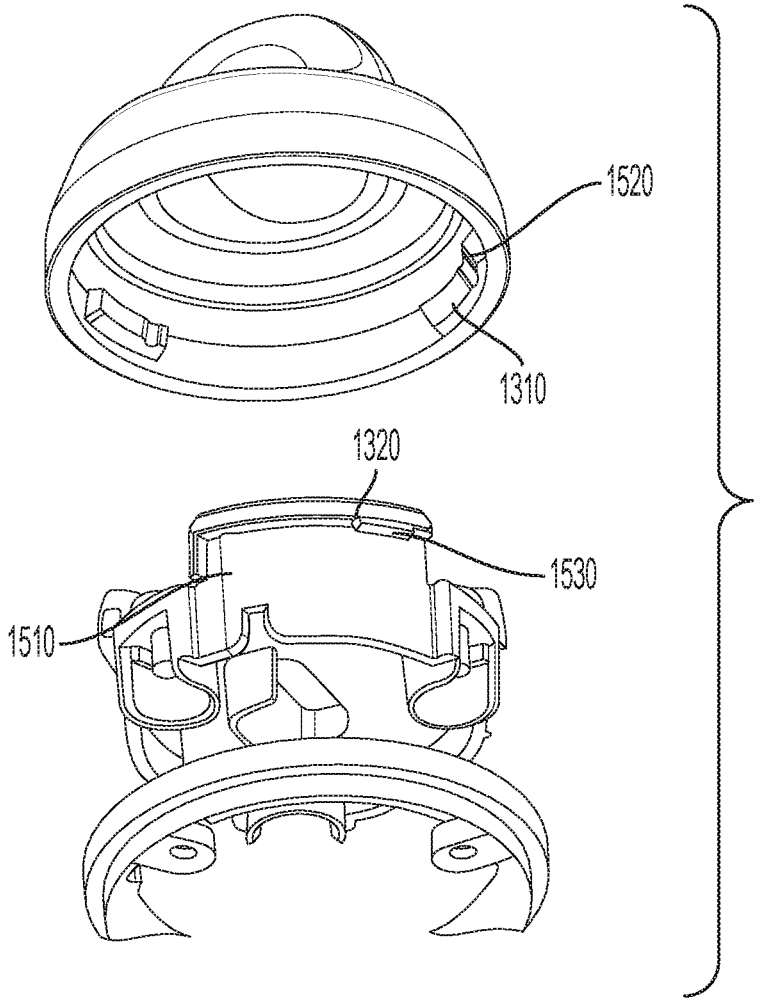
FIG. 15 shows a partial exploded view of the cap of the enhanced glowstick of FIG. 1.

FIG. 15 shows additional detail concerning the locking system. Cap 810 includes a detent 1520 that projects inward for locking. Inner cap 840 has a corresponding compression bump 1530. Rib 1310 has a positive lock feel once the cap 810 is turned such that it passes compression bump 1530. Detent 1520 eventually will turn and interface with rib 1510 and complete the lock. In this way the cap 810 maintains a smooth and consistent lock position compressing the rubber gasket 850.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A glowstick, comprising:

a lighting module including a body portion, a circuit board and a light source disposed on the circuit board having a primary direction of emission;

a polymer rod interfaced with the lighting module, the polymer rod having a length, a depth, and a width, wherein the length is greater than the depth and the length is greater than the width, the polymer rod proximate to the light source such that the primary direction of emission of the light source is aligned with the length of the polymer rod;

an internal cap positioned within the body portion and holding the circuit board in place; and a collet positioned within the body portion and holding the polymer rod and the circuit board in place, the circuit board interfaced with and positioned between the internal cap and the collet.

2. The glowstick of claim 1, wherein the polymer rod extends into the body portion.

3. The glowstick of claim 2, wherein the body portion includes an inner profile and the lighting module further includes a collar, the collet engaged with the inner profile, the collar, and the polymer rod such that the collet pushes the collar against the polymer rod and the inner profile, compressing the collar and holding the polymer rod in place.

4. The glow stick of claim 3, wherein the polymer rod is held via an interference fit.

5. The glowstick of claim 4, wherein the collar is between the polymer rod and the inner profile.

6. The glowstick of claim 5, wherein the inner profile has a step profile being more narrow towards an end of the polymer rod distal from the lighting module and less narrow towards an end of the polymer rod proximate to the lighting module, and the collar, the collet, the polymer rod, and the inner profile cooperate to assist in holding the polymer rod in place at the end of the polymer rod proximate to the lighting module.

7. The glowstick of claim 1, wherein the lighting module includes a lower body portion and a cap, wherein the internal cap is fixed in place and the cap interfaces with the internal cap to seal the cap to the lower body portion.

8. The glowstick of claim 7, wherein the internal cap includes a lip and the cap includes a rib and the lip and the rib interface.

9. The glowstick of claim 8, wherein the internal cap includes a rib along the lip and the cap include a detent, the detent interfacing with the rib when the cap is closed on the lower body.

10. The glowstick of claim 9, wherein the internal cap includes a compression bump near the lip, the compression bump interfacing with the rib to provide positive resistance to rotation of the cap.

11. The glowstick of claim 10, wherein a charge port is accessible under the cap through the internal cap.

12. A glowstick comprising:

a lighting module, including a body portion, a circuit board and a light source disposed on the circuit board, the light source having an emission direction;

a light diffusion element, the light diffusion element having a length, a width, and a depth, the length greater than the width and the length greater than the depth, the emission direction aligned with the length, the lighting module interfaced with the light diffusion element;

an inner cap positioned within the body portion and holding the circuit board in place; and a collet positioned within the body portion and holding the light diffusion element and the circuit board in place, the circuit board interfaced with and positioned between the inner cap and the collet.

13. The glowstick of claim 12, wherein the light diffusion element is a polymer rod.

14. The glowstick of claim 13, wherein the polymer rod extends into the body portion.

15. The glowstick of claim 14, wherein the body portion includes an inner profile and the lighting module further includes a collar, the collet engaged with the inner profile, the collar, and the polymer rod such that the collet pushes the collar against the polymer rod and the inner profile, compressing the collar and holding the polymer rod in place.

16. The glowstick of claim 12, wherein the body portion holds the light diffusion element using an interference fit.

17. The glowstick of claim 16, wherein a collar is included in the lighting module and the body portion and the light diffusion element compress the collar in providing the interference fit.

18. The glowstick of claim 12, wherein a charge port is accessible under a cap of the lighting module.

19. A method of using a glowstick, the method comprising:

providing a glowstick, the glowstick including:

a lighting module, including a body portion, a circuit board and a light source disposed on the circuit board, the light source having an emission direction;

an inner cap positioned within the body portion and holding the circuit board in place; and a light diffusion element, the light diffusion element having a length, a width, and a depth, the length greater than the width and the length greater than the depth, the emission direction aligned with the length, the lighting module interfaced with the light diffusion element, wherein the light diffusion element is a polymer rod extending at least partially into the body portion, and the body portion includes an inner profile and the lighting module further includes a collet and a collar, the collet positioned within the body portion and engaged with the inner profile, the collar, and the polymer rod such that the collet pushes the collar against the polymer rod and the inner profile, compressing the collar and holding the polymer rod in place, the collet holding the circuit board in place, the circuit board interfaced with and positioned between the inner cap and the collet, and a charge port is accessible under a cap of the lighting module;

removing the cap;

charging the lighting module;

replacing the cap; and activating the light source.

* * * * *